US005120089A

United States Patent [19]

Guttag

[11] Patent Number: 5,120,089

[45] Date of Patent: Jun. 9, 1992

[54] PROTECTED PHILATELIC ITEM

[76] Inventor: Alvin Guttag, 6612 Whittier Blvd., Bethesda, Md. 20817

[21] Appl. No.: 486,217

[22] Filed: Feb. 28, 1990

[51] Int. Cl.[5] ..... B42D 15/00

[52] U.S. Cl. ..... 283/71; 283/70; 283/117

[58] Field of Search ..... 283/70, 81, 71, 117; 282/1, 26, 27; 462/84, 66, 67

[56] References Cited

U.S. PATENT DOCUMENTS

| | | | |
|---|---|---|---|
| 53,081 | 3/1866 | Loewenberg | 283/71 X |
| 79,157 | 6/1868 | Sturgeon | 283/71 X |
| 101,020 | 3/1870 | Jones | 283/71 X |
| 1,005,696 | 10/1911 | Czettel | 283/71 X |
| 1,985,834 | 12/1934 | Lawrence | 283/71 |
| 2,250,197 | 7/1941 | Humphner | 283/71 X |
| 2,604,710 | 7/1952 | Beaune | 283/71 |
| 4,121,856 | 10/1978 | Brunette | 283/81 X |
| 4,121,961 | 10/1978 | Brunette et al. | 283/81 X |
| 4,640,714 | 2/1987 | Kagota . | |

FOREIGN PATENT DOCUMENTS

| | | | |
|---|---|---|---|
| 366425 | 2/1932 | United Kingdom | 283/71 |
| 469224 | 7/1937 | United Kingdom | 283/71 |
| 469225 | 7/1937 | United Kingdom | 283/71 |

*Primary Examiner*—Paul A. Bell

*Attorney, Agent, or Firm*—Cushman, Darby & Cushman

[57] ABSTRACT

The present invention relates to a method of protecting a philatelic item for alteration, which philatelic item bears a mark identifying an expert or owner of the item and possibly an additional distinguishable mark specific to the philatelic item. The invention further relates to a method of preventing fraudulent reuse of stamps.

18 Claims, 1 Drawing Sheet

BACK OF STAMP

COATED

CANCELLED

PROTECTED PHILATELIC ITEM

BACKGROUND OF THE INVENTION

1. Field of the Invention

The present invention relates to a method of protecting philatelic items against undetectable alterations and forgeries.

2. Background Information

Stamp collecting or philately is a hobby enjoyed by many people throughout the world. On occasion, stamps and other philatelic items have been altered or forged. Consequently, stamp collectors frequently use the services of experts or expertizing committees to authenticate the genuineness of their philatelic items. Typical of such expertizing services are: a) in the United States, the American Philatelic Expertizing, The Philatelic Foundation and the Germany Philatelic Society Expert Committee (GPSY); b) in England, The Royal Philatelic Society; c) in Austria, the experts of the "Verband Osterreischer Briefmarkenprüfer" (see Michel Osterreich-Spezial 1987 catalogue for example); and d) in Germany, the experts of the Bundes der philatelischen Prüfer e.V. (see Michel Deutschland—Spezial 1989 catalogue for example). In many cases the experts place their name or other mark showing their identity on the philatelic item.

Several years ago a genuine copy of Scott Standard Postage Stamp Catalogue United States No. C3a was sold at an auction in the United States. This stamp, known by stamp collectors as the "Inverted Jenny", has a catalogue value of over $100,000 and frequently sells for above that value. There are one hundred copies of the stamp known. The copy sold at the auction had been stolen many years before but had been altered to resemble another one of the 100 so that it would not be recognized as stolen. There were no marks on the stamp which would have made anyone recognize at once that this was the stolen one.

The present invention aims at preventing theft, alteration and forgery of philatelic items, as in the "Inverted Jenny" example.

SUMMARY OF THE INVENTION

It is an object of the present invention to make it readily recognizable when a philatelic item has been altered or is a forgery.

Another object of the present invention is to prevent alteration of an identifying mark placed on a philatelic item by an expert, expert committee or the owner of a philatelic item.

A further object of the present invention is to provide a mark specific to each philatelic item in addition to the mark identifying an expert or owner.

In one embodiment, the present invention relates to a philatelic item containing a mark identifying an expert or owner of the item and an additional mark specific to the philatelic item.

In another embodiment, the present invention relates to a philatelic item containing a mark identifying an expert or owner and means applied to the mark for detecting any alteration of the mark.

In a further embodiment, the present invention relates to a method of protecting an identifying mark on a philatelic item from alteration by applying to the mark a means for detecting any alteration of said mark.

In yet another embodiment, the present invention relates to a method of protecting a philatelic item bearing a mark identifying an expert or owner of the item from alteration comprising placing on the item a distinguishable mark specific to said item.

A more complete appreciation of the present invention and many of the attendant advantages thereof will be readily understood by reference to the following detailed description.

All publications mentioned herein are hereby incorporated by reference.

DETAILED DESCRIPTION OF THE INVENTION

The term "philatelic item" as used herein includes, for example, a stamp whether by itself or on piece or on a cover; an envelope including stampless envelopes, postal stationery, items included in the Scott catalogue classification under U, UC, UO, UX, UXC, UY and UZ, items included in the Michel Ganzsachen-Katalog Europa West 1986 pages 12–13 and in The Michel Ganzsachen-Katalog Deutschland 1989 page 15, postal cards and postcards. It also includes reprints both official and unofficial.

Figure 1:
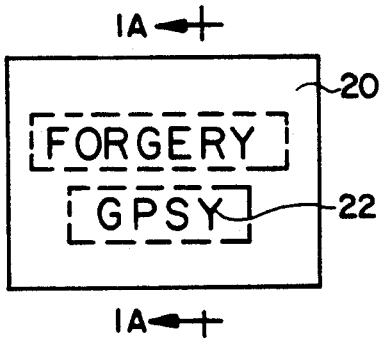
FIGS. 1 and 1A show two views of a stamp with an expert mark on its back, which mark is protected from undetectable alteration by a plastic coating.
Figure 1A:
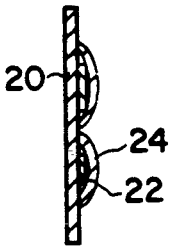

In one embodiment of the present invention, a mark 23 of an expert, expert committee or owner, is applied to a philatelic item, e.g., a stamp 20, in the customary manner, and then applied over the mark is a plastic 24 which permits the mark to be seen (see FIG. 1). Since any attempt to remove the plastic results in evidence that the item has been tampered with, a prospective buyer of the philatelic item is made aware of any attempt to change the authentication mark.

Many experts not only mark a philatelic item as genuine but also mark it as false such as "Falsch," in the German area, or as a forgery. These markings to indicate a forgery are included in the marks which can be protected by plastic according to the present invention.

When experts mark stamps they normally do this on the back. If the stamp is "on piece" this obviously cannot be done but instead the piece is marked on back, normally in the area of the stamp. On other philatelic items, the marking is done where the expert consider, it appropriate. Markings on all such locations on philatelic items can be protected by plastic according to this invention.

Permissible plastics for use in the present invention are clear plastics including, but not limited, to polyvinyl alcohol, hydroxyethyl acrylate polymer, hydroxyethyl methacrylate polymer, hydroxyethyl acrylate-ethylene glycol diacrylate copolymer, hydroxyethyl methacrylate-ethylene glycol dimethacrylate copolymer, or hydrocarbon polymers such as polyethylene, polypropylene, ethylene-propylene copolymer and polystyrene as well as other polymers e.g. polyethylene, terephthalate, cellulose acetate and cellulose acetate propionate. The polymer can be either unoriented or oriented. An example of an oriented polymer which can be used in the present invention is the Mylar form of polyethylene terephthalate.

The plastic normally is applied only to the small area of the identifying mark since collectors do not like to have their philatelic items altered any more than necessary by the authenticating means. In addition, the plastic chosen should be one that does not damage the philatelic item. The plastic most preferably is applied directly but can be applied with an adhesive.

Figure 2:
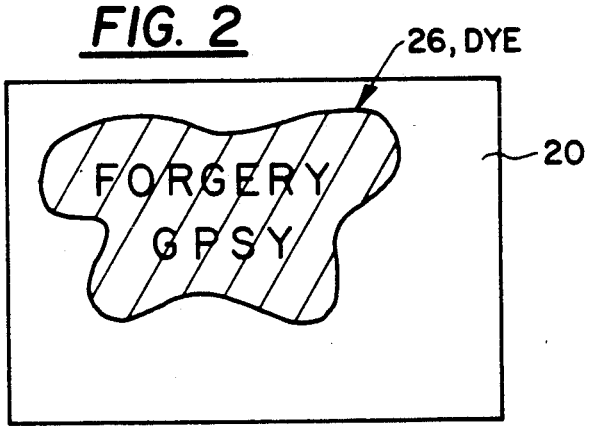
FIG. 2 shows a stamp with an expert mark on its back, which mark is protected from undetectable alternation by a plastic coating containing a dye. The hatched lines indicate where the stamp has been dyed as a result of tampering with the expert mark.

In another embodiment of the present invention, to further ensure that no alteration of the authentication mark occurs, there is employed a plastic containing a dye. Thus, for example, a water soluble polymer is used to protect the expert's mark. When water or other solvent is used in an attempt to remove the plastic and alter or remove the expert mark, the dye will leach out and stain 26 the philatelic item 20 (see FIG. 2). Preferably a polymer is chosen which is unaffected by the organic solvents normally used to detect watermarks.

In another embodiment of the present invention, as another means for preventing the alteration of the expert or owner mark on a philatelic item, e.g. a postage stamp, microcapsules containing a color-forming dye are applied over the mark. The microcapsules are applied directly or as part of a plastic film. Any attempt to alter the mark such as by abrading it, results in breakage of the microcapsules and forming the color thereby staining the philatelic item and showing that the mark has been altered.

Microcapsules containing dye developing ingredients are well known items of commerce per se. Conventional dye containing microcapsules such as those used in the making of carbonless "carbon" paper for business forms are usable for protecting the philatelic items from alterations in the present invention.

Microcapsule systems that can be used in the present invention include for example those shown in Kagota U.S. Pat. No. 4,640,714, in the description of the prior art on col. 1, line 50 to col. 2, line 3 as well as in the description of the invention, col. 2, lines 23–43 and the detailed description of the invention, Examples 1–3. Attempts to remove or alter the mark having a coating of these microcapsules would cause the development of the dye and thus show such alteration.

Normally, an expert only places an identifying mark which shows who he or the committee is who is giving the expert opinion. In another embodiment of the present invention the expert also adds a further distinguishable mark which identifies the specific philatelic item being marked (designated herein a "distinguishable mark"). Thus, in the case of the "Inverted Jenny" mentioned above, wherein all 100 positions are known, the expert would mark on the stamp which position the stamp is in of the 100. This would prevent alteration of a genuine stolen philatelic item so that it would resemble another genuine philatelic item since the presence of the position number would immediately notify a prospective purchaser of the alteration. The same protective plastic covering and/or microencapsulated dye of the present invention can also be applied over this further identification of the philatelic item.

The expert or expert committee can individualize the marking of the philatelic item in ways other than by position to distinguish each specific philatelic item. Thus, for example, it can serially number the various copies of the philatelic item it has expertized such as the third copy of Scott, Baden 4b to be marked by the expert could have the identification after his or her name "3". Alternatively, the expert can serially number all philatelic items expertized by him or her starting with 1 and going to 500 or more. Since there are only a limited number of experts, stamp collectors can be easily informed such as through catalogues like Scott or Michel, as to the method of individual identification for each expert.

In another embodiment of the present invention, microcapsules containing a dye are used to prevent fraudulent reuse of stamps. A major problem in many countries, such as the United States and Great Britain, is the reuse of stamps. It has been estimated that Great Britain loses 25 million pounds of revenue a year (LINN's Stamp News, Nov. 13, 1989, pg. 2) and the United States 50 million dollars a year (LINN's stamp News, Feb. 12, 1990, pg. 1) from the washing and reuse of stamps. This fraudulent reuse occurs when the cancellation mark on a stamp is washed off and the stamp regummed and reused.

Figure 3:
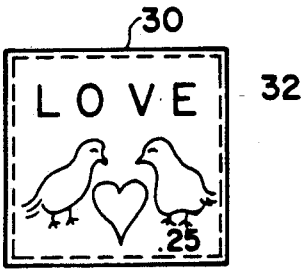
FIG. 3 shows the front of a stamp which is coated with a color-developing dye.
Figure 4:
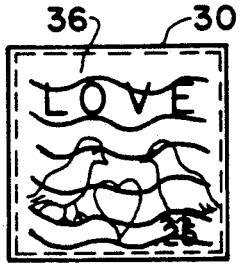
FIG. 4 shows the front of a used stamp which has received a cancellation mark.
Figure 5:
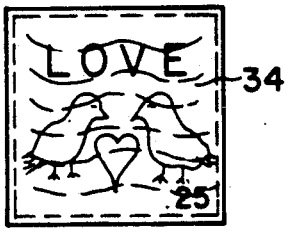
FIG. 5 shows the front of a used stamp which is coated with a color-developing dye where the cancellation mark has been partly washed off. The use of the stamp is still easily detected from the stained face which is a result of the activation color-developing dye.

The present invention can be used to eliminate such fraudulent reuse of stamps by applying to the face of a stamp or a portion of the face of a stamp 30 a coating 32 containing microcapsules of a color developing dye, e.g. such as any of those mentioned above, e.g. in the Kagota patent (see FIG. 3). When the cancellation mark 36 is applied the microcapsules will break causing a stain 34 to appear on the stamp which cannot be washed off (see FIG. 4). This would provide easy detection of used stamps even if the cancellation mark has been removed (see FIG. 5) and prevent their reuse.

While the foregoing invention has been described in some detail for purposes of clarity and understanding, modifications will occur to those of ordinary skill in the art and it is desired to cover in the appended claims all such modifications as falling within the true scope of the invention.

What is claimed is:

1. A philatelic item containing an expert's or owner's identifying mark and a coating applied to said mark for detecting any alteration of the mark, wherein said coating comprises a plastic and a dye.

2. The philatelic item according to claim 1 which is a postage stamp.

3. A philatelic item according to claim 2 wherein the mark is on the back of the stamp.

4. The philatelic item according to claim 1 wherein said mark is applied to the back of the philatelic item and said coating is applied to an area of the philatelic item essentially limited to and covering the identifying mark.

5. The philatelic item according to claim 1 which is a stamp and wherein the dye in at least a part of the area of the stamp covered by the dye has changed color.

6. The philatelic item according to claim 1 wherein the dye is a color changeable dye.

7. A method of protection an owner's or expert's identifying mark on a philatelic item from alteration comprising applying to said mark a coating for detecting any alteration of said mark, wherein said coating comprises a plastic and a dye.

8. The method according to claim 7 wherein said plastic includes microencapsulated dye which will change color when the mark is tampered with.

9. The method according to claim 7 wherein said dye changes color when the mark is tampered with.

10. The method according to claim 7 wherein said dye is microencapsulated and said capsules rupture when the dye is tampered with.

11. A method of preventing the reuse of a cancelled stamp comprising cancelling a stamp having an external clear coating of a plastic and a dye on its front surface, the coating being such that when the stamp is cancelled the pressure of cancellation causes the dye to stain the stamp, wherein said cancelling is effected with sufficient pressure to cause the dye to stain the stamp.

12. The method according to claim 11 wherein the dye is microencapsulated and the cancelling is carried out with sufficient force to break the capsules.

13. The method according to claim 11 wherein the dye is color changeable and the pressure causes the dye to change color.

14. The method according to claim 13 wherein the dye is microencapsulated and the cancelling is carried out with sufficient force to break the capsules.

15. A stamp having an external clear coating of a plastic and a dye on its front surface, the coating being such that when the stamp is cancelled, the pressure of cancellation causes the dye to stain the stamp.

16. The stamp according to claim 15 wherein the dye is microencapsulated.

17. The stamp according to claim 15 wherein the dye is color changeable and the pressure causes the dye to change color.

18. The stamp according to claim 17 wherein the dye is microencapsulated.

* * * * *